US005295498A

United States Patent [19]

Van Meter et al.

[11] Patent Number: 5,295,498

[45] Date of Patent: Mar. 22, 1994

[54] DEVICE TO AID PERSONS RISING FORM A SEATED POSITION

[76] Inventors: Larry E. Van Meter, 901 Latham St., Colton, Calif. 92324; Leonard B. Van Meter, 31813 Tennessee St., Yucaipa, Calif. 92399

[21] Appl. No.: 20,046

[22] Filed: Feb. 19, 1993

[51] Int. Cl.[5] ..... A45B 7/00

[52] U.S. Cl. ..... 135/65; 135/76; 297/DIG. 10; 256/1; 256/59; 4/254

[58] Field of Search ..... 135/65, 66, 67, 72, 135/77, 76; 256/1, 59; 297/217, DIG. 10; 5/81 R; 4/254

[56] References Cited

U.S. PATENT DOCUMENTS

| | | | |
|---|---|---|---|
| 2,757,388 | 8/1956 | Chisholm | 135/65 X |
| 3,553,746 | 1/1971 | Seiger | 5/317 |
| 3,591,874 | 7/1971 | O'Kennedy | 5/81 |
| 3,695,609 | 10/1972 | Rothe | 272/703 |
| 3,739,793 | 6/1973 | Wilson | 135/45 |
| 4,843,661 | 7/1989 | Skibinski | 5/81 R |
| 4,844,107 | 7/1989 | Watkins | 135/65 |
| 4,922,560 | 5/1990 | Skibinski | 5/81 R |
| 4,941,495 | 7/1990 | Boyce et al. | 135/65 |
| 5,007,618 | 4/1991 | Libby | 135/65 X |

*Primary Examiner*—Carl D. Friedman
*Assistant Examiner*—Lan C. Mai
*Attorney, Agent, or Firm*—Harvey S. Hertz

[57] ABSTRACT

A device to aid persons rising from a seated position. The device comprises a structural support having a base positionable under a chair and a brace secured to the base. A sleeve is secured to the structural support for securing one end of an arm thereto. The other end of the arm has a griping section enabling a person seated in the chair to grasp the arm and pull himself up to an upright position.

3 Claims, 1 Drawing Sheet

FIG. 1
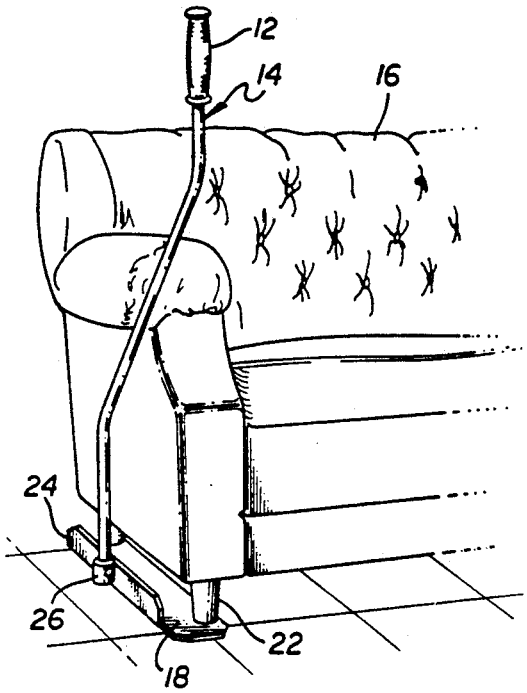
FIG. 2
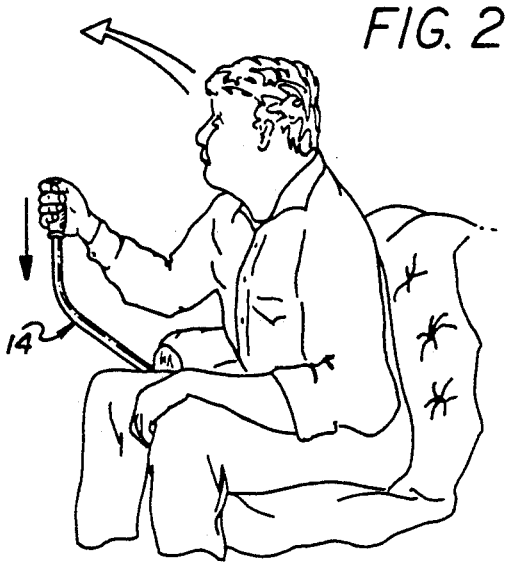
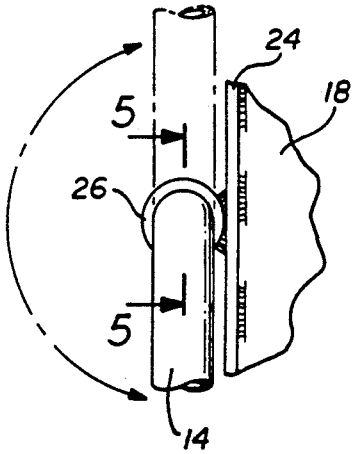
FIG. 4
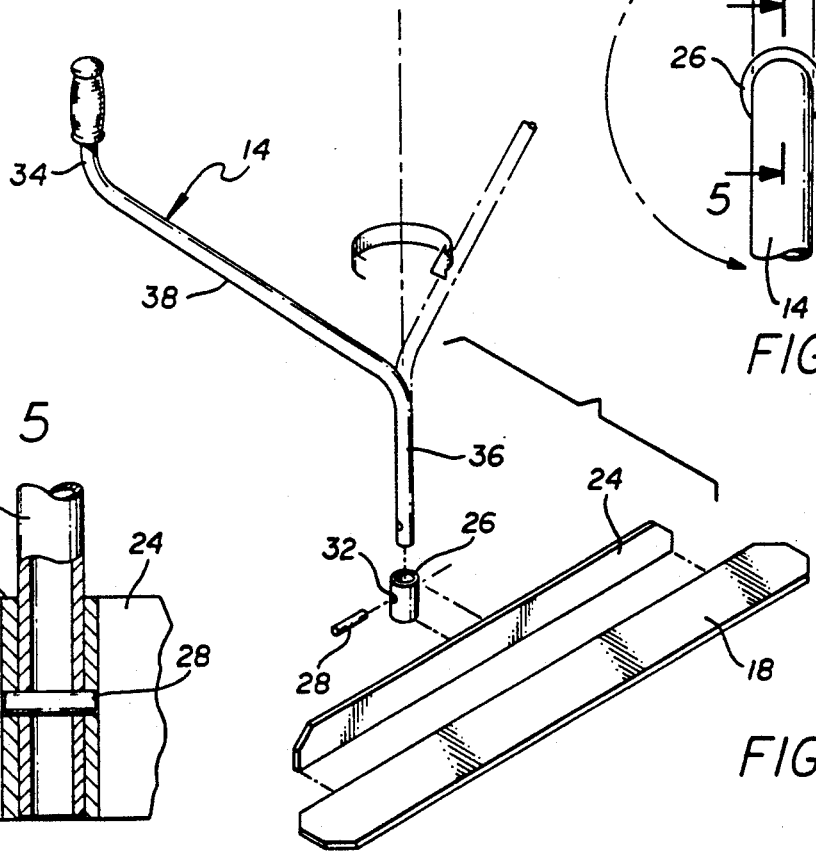
FIG. 3
FIG. 5
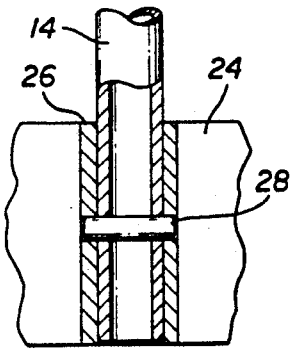

DEVICE TO AID PERSONS RISING FORM A SEATED POSITION

BACKGROUND OF THE INVENTION

1. Field of the Invention

The invention relates to devices that assist people as they rise up from a seated position, and, more particularly, to a reversible aid which can be placed on either side of a chair.

2. Description of the Prior Art

Many persons have difficulty rising from a seated position, because of an infirmity due to illness, advance age, or other debilitation. This difficulty is of special concern when chairs and couches are used as seating devices, as the individual may deeply seat in the cushioning, aggravating any difficulty in getting up. Devices that utilize a handle to permit the seated person to grab hold of and pull on while rising are well known. These devices are normally not connected to any particular piece of furniture and, thus, may be employed where the individual may be seated.

Typical devices utilize a pair of bars which are positioned in front of the person as he rises. These devices normally must be positioned under and in front of the chair and typically will block the view of the user or are obtrusive. Known prior art includes U.S. Pat. Nos. 3,553,746; 4,844,107; 4,922,560; 4,843,661; 3,591,874; 3,739,793; 4,941,495; and 3,695,609.

The present invention can be placed on either side of a chair and enables the user to grasp the device with one hand and rise up out of the chair or seating device such as a couch. The device is reversible so that it may be placed on either side of the chair. The device is not placed in front of the user so that his view is normally not blocked and is not obtrusive.

SUMMARY OF THE INVENTION

A device to aid persons rising from a seated position is formed of a structural support having a structural horizontal support base positionable under a chair and a brace secured to the support base. A sleeve is secured to the structural support for securing one end of an arm thereto. The other end of the arm has a griping section enabling a person seated in the chair to grasp the arm and pull himself up to an upright position. The arm may be reversible in the sleeve so that the brace can be positioned on either side of the chair.

The advantages of this invention both as to its construction and mode of operation, will be readily appreciated as the same becomes better understood by reference to the following detailed description, when considered in connection with the accompanying drawings in which like reference numerals designate like parts throughout the figures.

BRIEF DESCRIPTION OI THE DRAWINGS

FIG. 1 is a perspective view of the device shown mounted under a seat.

FIG. 2 is a perspective view illustrating a user utilizing the device of FIG. 1.

FIG. 3 is an exploded perspective view of the device of FIG. 1.

FIG. 4 is a partial top plan view of the device of FIG. 1.

FIG. 5 is a cross-sectional view taken along the line 5—5 of FIG. 4.

DESCRIPTION OF THE PREFERRED EMBODIMENT

Referring now to the drawings, there is shown in FIG. 1 a structural support to aid persons rising from a seated position which includes a handle 12 positioned at one end of an arm 14. Typically, the user seated in a couch 16 or other chair, grasps the handle 12 (FIG. 2) to rise from the couch or chair. The device further includes a horizontal base 18 which is mounted beneath the legs 22 of the couch causing the device to stabilize under the weight of the couch. A vertical brace 24 is welded or otherwise secured along the outer edge of the horizontal brace and contains a hollow sleeve 26 having the lower end of the arm 14 secured therein. Normally the sleeve 26 is welded to the outer surface of the vertical brace 24 as can be seen in FIG. 4.

As illustrated in FIG. 3, the arm 14 is reversibly secured in the sleeve 26 by means of a pin 28 which fits through openings 32 formed in the sleeve 26 (FIG. 5).

The arm 14 contains an upper vertical section 34 to which the handle is secured and the lower vertical section 36 which is inserted into the sleeve 26. The central section 38 of the arm interconnects the upper and lower vertical arm sections 34 and 36, respectively, and extends at an angle with respect to the vertical axis of the upper and lower arm sections 34 and 36. Thus, as can be seen in FIG. 2, with the arm upper vertical section 34 in a first position extending forward from the couch 16, the user can grasp the handle with his right hand. When the arm 14 is reversed by rotation showing the arrow in FIG. 3 to a second position shown in dotted lines, the arm 14 can be positioned on the opposite side of the couch 16. Thus, the device is usable on either side of the couch or a chair.

We claim:

1. A device to aid persons rising from a seated position comprising:

an elongated generally vertically positioned arm having a lower end and an upper free end;

an elongated horizontal support base positionable under the legs of a seat;

a vertically formed planar brace having an outer surface, said planar brace being secured to an edge of said support base in a plane perpendicular to said support base;

a sleeve secured to said vertically formed planar brace along said outer surface for securing the lower end of said arm thereto; the upper free end of said arm having a grip section enabling a seated person to grasp said arm grip and put themself to an upright position.

2. A device in accordance with claim 1 wherein said arm is reversibly positioned in said sleeve for mounting on an opposite side of said chair.

3. A device in accordance with claim 1 wherein said arm contains an upper generally vertical section integral with said grip section, a lower generally vertical section inserted in said sleeve and an intermediate section interconnecting said arm upper and lower sections and extending at an angle with respect to the axes of said arm upper and lower vertical sections.

* * * * *